US006016584A

United States Patent [19]

Melroe

[11] Patent Number: 6,016,584

[45] Date of Patent: Jan. 25, 2000

[54] LATERAL SWEEPING APPARATUS

[75] Inventor: Irving L. Melroe, Longmont, Colo.

[73] Assignee: M-B Companies, Inc. of Wisconsin, New Holstein, Wis.

[21] Appl. No.: 09/126,035

[22] Filed: Jul. 29, 1998

Related U.S. Application Data

[60] Provisional application No. 60/055,033, Aug. 8, 1997.

[51] Int. Cl.[7] ..... E01H 1/05

[52] U.S. Cl. ..... 15/78; 15/82; 15/183

[58] Field of Search ..... 15/78, 80–82, 15/179, 183

[56] References Cited

U.S. PATENT DOCUMENTS

| | | | |
|---|---|---|---|
| 30,644 | 11/1860 | Longley | 15/82 |
| 1,630,719 | 5/1927 | Schroeder | 15/183 |

FOREIGN PATENT DOCUMENTS

| | | | |
|---|---|---|---|
| 230631 | 1/1911 | Germany | 15/78 |
| 2541 | 7/1877 | United Kingdom | 15/78 |

*Primary Examiner*—Mark Spisich
*Attorney, Agent, or Firm*—John R. Ley

[57] ABSTRACT

Loose material is transferred from a surface primarily laterally outward with respect to a forward direction of movement. A plurality of elongated strip brush members are oriented at a predetermined acute angle and moved in an oval rotational pattern about a rotational axis and simultaneously in longitudinal movement parallel to the rotational axis. The movement of the strip brush members induces substantially more pushing movement on the loose particles in a direction laterally outward parallel to the rotational axis than in a direction perpendicular to the rotational axis. The strip brush members contact with and withdraw from the surface in a substantially vertical orientation.

20 Claims, 7 Drawing Sheets

LATERAL SWEEPING APPARATUS

CROSS-REFERENCE TO PROVISIONAL APPLICATION

Reference to, and a claim to the priority benefit of (under 35 U.S.C. 119(e)), is made to a prior United States provisional application of the inventor herein, Ser. No. 60/055,033, filed Aug. 8, 1997, for a "Lateral Sweeping Apparatus."

INTRODUCTION

This invention relates to powered apparatus and methods for sweeping loose materials. More particularly, this invention relates to new and improved powered sweeping apparatus and methods with reduced air turbulence and reduced discharge into the environment of the loose materials, such as dirt and dust. Even more particularly, the present invention relates to new and improved apparatus and methods for sweeping a path and simultaneously moving a substantial amount of the loose materials into a row-like accumulation without discharging those loose materials into the ambient air and without projecting those loose materials into adjacent paths which have already been swept clean.

BACKGROUND OF THE INVENTION

Conventional powered brooms typically utilize an elongated cylindrical drum having a plurality of stiff bristles projecting radially outwardly from the periphery of the drum. The drum is normally rotated about its axis at high speed (e.g., 160 rpm) in a manner such that the bristles engage the surface to be cleaned as the drum is rotated. The bristles push the loose material (i.e., dirt and dust) forward and also lift the loose material upwardly by the action of the bristles being released from contact with the surface being cleaned. The resilient bristles inherently bend backwardly when contacting the loose materials and the surface being cleaned and then the bristles spring forwardly after the drum has rotated to a point where the bristles lose contact with the surface. When the bristles spring forwardly, they tend to flip or project particles of the loose material into the air and in a trajectory in front of the rotating drum of bristles.

The constant springing back and forth of the bristles causes problems. A dust or air pollution problem is created by the continual lifting and projection of the loose particles into the air. The air turbulence created by the high speed rotation of the drum with outwardly extending bristles further disburses the dust cloud around the broom and keeps the loose particles airborne during operation of the power broom. The cloud of dust and loose materials may create a potential health hazard. It is not unusual that operators of such power brooms must wear air-filtering breathing apparatus or that the powered broom device must have an enclosed operators cab. Furthermore, the forward trajectory of the loose particles, and the accompanying cloud, scatter dirt and loose materials to secondary areas which must then be cleaned. This is particularly inefficient in cleaning large areas, because the loose particles may project and settle onto areas which have previously been swept, requiring those areas to be cleaned again.

Dust suppression systems have been developed for use with conventional powered brooms. The typical dust suppression system sprays a fine mist of water into the cloud. Such dust suppression systems require a relatively large tank of water to be carried on the powered broom device. If the powered broom apparatus is of an insufficient size to carry a relatively large tank of water, the operator must stop sweeping at frequent intervals to refill the tank. It may also be necessary to increase the size of the powered broom device to accommodate a relatively large water tank. Such dust suppression systems may be expensive and usually require periodic and substantial maintenance due to the added complexity and added components, such as pumps, motors, hoses, connections, etc. Furthermore, adding water to the loose material is undesirable because it leaves visible tracks and also creates mud-like mixtures of the loose particles. It is considerably more difficult to sweep mud-like mixtures of loose particles than to sweep the dry particles.

It is also common practice to slightly angle the rotational axis of the rotating bristle drum relative to the direction of movement in order to transfer the loose material slightly laterally, as the rotating bristles push the material forward. However, because the primary sweeping action is a forward pushing movement perpendicular to the rotational axis of the drum, and because the angle of the rotating drum of bristles is not a substantial angle, the loose particles move in a more forward direction than in a lateral direction. By continually moving the same loose particles in more of a forward direction than in a lateral direction, more dust and airborne clouds of particles result before the particles have been moved sufficiently to the side of the swept area. The circular rotational movement of the bristles and the slight angular displacement of the rotating drum requires that more sweeping action be applied before the loose particles are moved clear of the swept area. Furthermore, because of the slow lateral movement of the loose particles, the powered broom device might be operated at a slower forward advancement movement rate or the rotating rate of the bristle drum must be increased, to assure that enough sweeping energy is applied to clear the loose particles from the swept area.

In agricultural applications, side discharge rakes are used to create "windrows" of cut grass, plant stalks, grain crop stalks after harvesting, and the like. One type of side discharge rake has a plurality of bars which rotate in parallel in oval shaped paths and at an angle to the forward movement of the rake itself. The effect of the oval rotational path is to move the bars with a significant lateral movement component compared to the forward movement component of the rake. Each of the bars includes a number of spring teeth connected to it along its length. The spring teeth contact the previously-cut plant stalks and rake them to the side into the windrows. The spring teeth are resilient wire-like projections of approximately six to eight inches in length which extend from the parallel bars a sufficient distance to contact the cut plant stalks but not to contact stones or the soil. The spring tooth projections will also easily move through the upright bases of the plant stalks which remain in the soil after the stalks have been cut. After the windrows have been created by the action of the side discharge rake, another agricultural implement picks up the windrows of plant stalks. The plant stalks are thereafter formed into bales or are otherwise stored to be used for livestock feed.

Side discharge rakes are not suitable for sweeping. In fact, spring teeth of the side discharge rake are not intended to contact the soil, because contacting the soil might result in the introduction of stones and soils into the plant stalks, which would diminish the value as livestock feed and possibly create health problems for the livestock. The spring teeth are intended to efficiently avoid the bases of the plant stalks which remain in the soil. These considerations, and others, prevent and do not suggest the use of a side discharge rake in sweeping or broom applications.

It is with respect to this and other background information that the present invention has evolved.

SUMMARY OF THE INVENTION

In general, one of the improvements of the present invention is the ability to minimize the amount of dust and the extent of airborne particles generated during sweeping. Another improvement involves moving loose particles during sweeping with an action which reduces the possibility of launching the loose particles into an airborne trajectory, to reduce or prevent airborne clouds of the loose particles. A further improvement involves minimizing the projection of loose particles during sweeping into areas which have previously been swept. Still a further improvement relates to moving the loose particles more efficiently in a lateral direction to reduce the amount of sweeping energy required to sweep a specific area. Yet another improvement involves sweeping in a manner which moves the particles more effectively in a lateral direction and thereby reduces the forward movement of the particles when sweeping an area. It is not believed that previous sweeping apparatus have obtained these and other advantages, improvements and benefits.

In general, the present invention is for a sweeping apparatus for transferring loose material from a surface primarily laterally outward with respect to a forward direction of movement. The sweeping apparatus comprises a frame structure, and a rotating brush assembly having a plurality of elongated strip brush members which are oriented at a predetermined acute angle and which move simultaneously in an oval rotational pattern about a rotational axis and in longitudinal movement parallel to the rotational axis. The movement of the strip brush members induces substantially more pushing movement on the loose particles in a direction laterally outward parallel to the rotational axis than in a direction perpendicular to the rotational axis. Preferably, the strip brush members contact with and withdraw from the surface in a substantially vertical orientation.

In another embodiment, the sweeping apparatus includes first and second disk members rotatably connected to the frame structure to rotate in parallel planes with respect to one another, and a plurality of elongated bar members connected to and extending between corresponding locations on the first and second disk members. The bar members extend generally parallel to one another and at a predetermined acute angle with respect to the rotational plane of each disk member. Each bar member connects to a disk member at a rotational joint which permits rotation of the disk members and simultaneous rotational and longitudinal movement of the parallel bar members in an oval rotational pattern about a rotational axis. The brush members are connected to the bar members. The brush members have bristles which move into contact with the surface and push loose particles on the surface as each bar member moves rotationally in the oval rotational pattern about the rotational axis and as each bar member moves longitudinally in a laterally outward direction parallel to the rotational axis during movement in the rotational pattern. The component of the longitudinal pushing movement from the bristles is greater than the component of pushing movement from the bristles from rotation of the bar members in a direction perpendicular to the rotational axis.

Another embodiment of the invention is a method of sweeping loose material from a surface primarily laterally outward with respect to a forward sweeping direction. The method comprises the steps of rotating a plurality of elongated strip brush members in an oval rotational pattern about a rotational axis, simultaneously moving the plurality of elongated strip brush members longitudinally parallel to the rotational axis during a portion of the rotational pattern, orienting the rotational axis at a predetermined acute angle with respect to a perpendicular reference to the forward sweeping direction, contacting the strip brush members with the surface to push loose particles during that portion of the oval rotational pattern when the elongated strip brush members move longitudinally, and contacting the strip brush members with the surface and withdrawing the strip brush members from the surface in a substantially vertical orientation.

Other preferred aspects of the invention include extending the rotational axis at an angle of from 12 to 35 degrees with respect to a perpendicular reference to the forward direction of movement, and preferably at an angle of approximately 25 degrees. The sweeping apparatus is preferably connectable to the front end of a skid steer vehicle, at its boom arms and with a quick attachment mechanism. Gauge wheels are preferably connected to the frame structure for supporting the sweeping apparatus with respect to the surface, and the amount of contact of brush members with the surface is controlled by tilt and swivel control mechanisms of the skid steer vehicle in conjunction with the gauge wheels. A source of rotational energy for the strip brush members and brush assembly is preferably derived from the hydraulic system of the skid steer vehicle.

The primary lateral movement of the brush members against the particles effectively transfers those particles to the side of the swept path, without moving them forward into the path where they would again have to be contacted or forwardly into an adjacent previously swept path. Consequently, the sweeping action is more efficient, allowing the path to be swept clean with less energy. Furthermore, because of the vertical lifting action of the brush members that the conclusion of contact with the surface, the loose particles are not projected into the air, thereby avoiding substantial amount of dust and airborne pollution.

A more complete appreciation of the present invention and its scope, and the manner in which it achieves the above noted improvements, advantages and features can be obtained by reference to the following detailed description of presently preferred embodiments of the invention taken in connection with the accompanying drawings, which are briefly summarized below, and to the appended claims.

DETAILED DESCRIPTION

Figure 1:
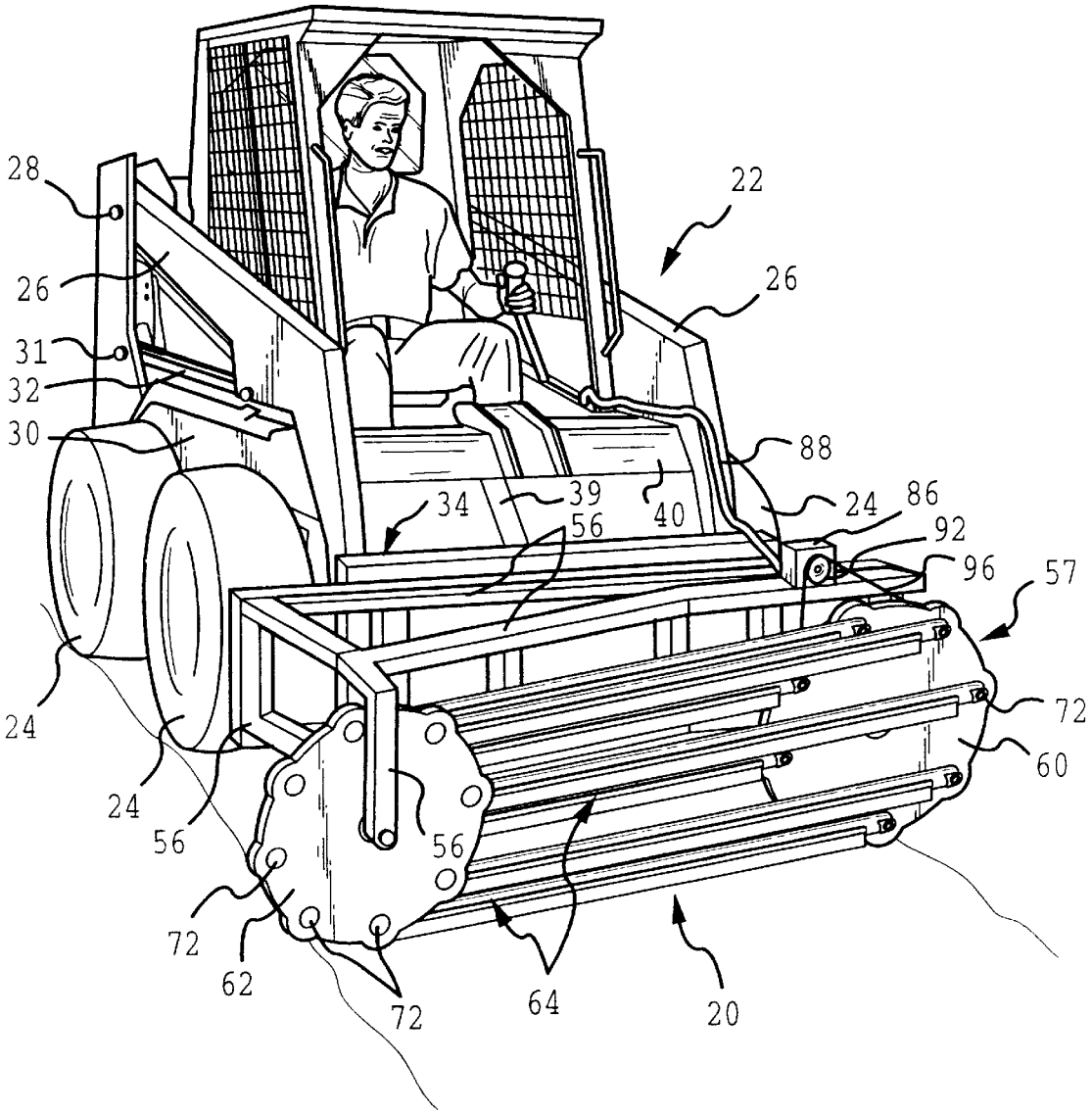
FIG. 1 is a perspective view of a conventional skid steer vehicle to which there is attached an embodiment of a lateral sweeping apparatus which incorporates the present invention.
Figure 2:
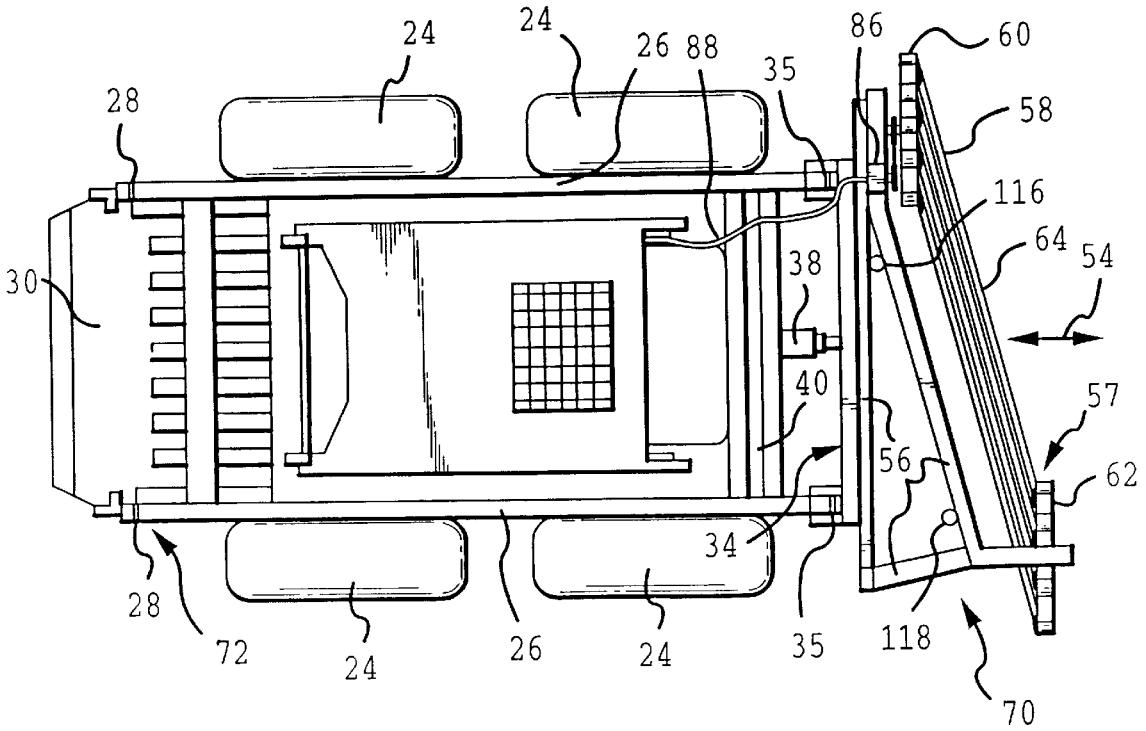
FIG. 2 is a top plan view of the vehicle and sweeping apparatus shown in FIG. 1.
Figure 3:
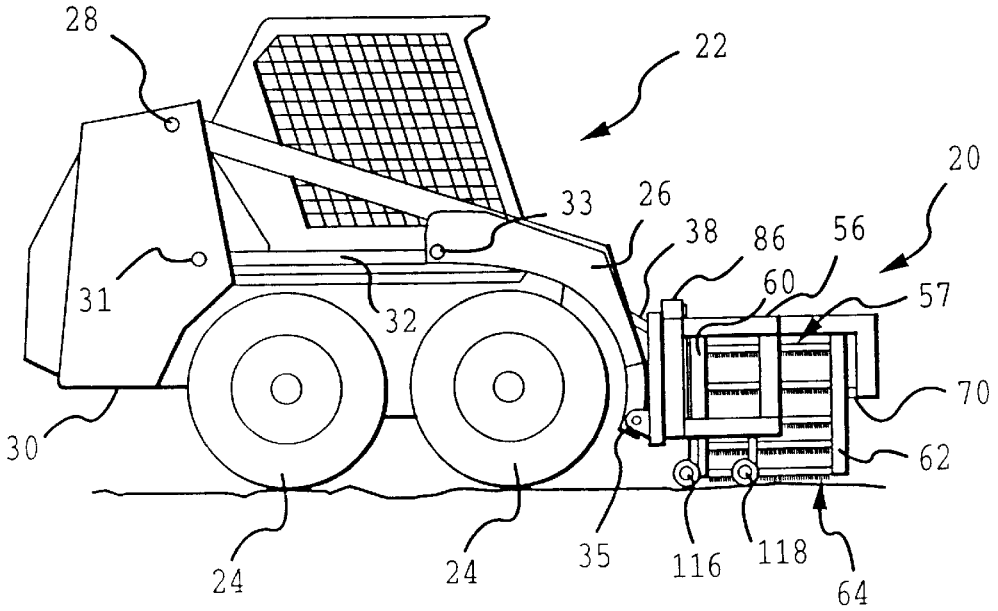
FIG. 3 is a side elevation view of the vehicle and sweeping apparatus shown in FIGS. 1 and 2.

An embodiment 20 of a lateral sweeping apparatus which incorporates the present invention is shown in FIGS. 1–3. The sweeping apparatus 20 is shown attached to a conventional skid steer vehicle 22, such as a "Bobcat" skid steer vehicle manufactured by the Melroe Company of Fargo, N.Dak., USA. The skid steer vehicle 22 is self propelled by an engine and a power delivery and hydraulic system (none shown) which transfer power to four wheels 24 of the vehicle 22 and which deliver pressurized hydraulic fluid for operation of various components, implements and attachments of the vehicle 22. By independently controlling the power applied to the pairs of wheels 24 on each side of the vehicle 22, the direction and speed of the vehicle is controlled. Maneuvering is accomplished by a differential in the rotational speed and direction of rotation of the wheels 24 on opposite sides of the vehicle 22, thus turning the vehicle by skidding the wheels.

The skid steer vehicle 22 also includes a pair of boom arms 26 on opposite sides of the vehicle 22. Each of the boom arms 26 is pivotally attached at a relatively high location 28 on a rear end of a frame structure 30 of the vehicle 22. A hydraulic cylinder 32 for each boom arm 26 extends from a rear location 31 on the frame structure 30 to a front location 33 on the boom arm 26. When the hydraulic cylinders 32 are extended by hydraulic pressure created by the hydraulic system (not shown) of the vehicle 22, the boom arms 26 pivot about the locations 28 and the front ends of the boom arms 26 are lifted. Controlling the extension of the hydraulic cylinders 32 establishes the elevational position of the front ends of the boom arms 26 and any attachments and implements connected to them, such as the sweeping apparatus 20.

A variety of different implements and devices are available to be attached to the front ends of the boom arms 26. For example, a very common attachment is a scoop bucket (not shown), thus making the skid steer vehicle 22 into a skid steer loader. To accommodate attaching a variety of different implements and attachments, the front ends of the boom arms 26 are connected to a quick attachment mechanism 34, also shown in FIGS. 4 and 5. The quick attachment mechanism 34 allows the different implements and attachments, such as the sweeping apparatus 20, to be connected and disconnected rapidly and conveniently from the front ends of the boom arms 26.

Figure 4:
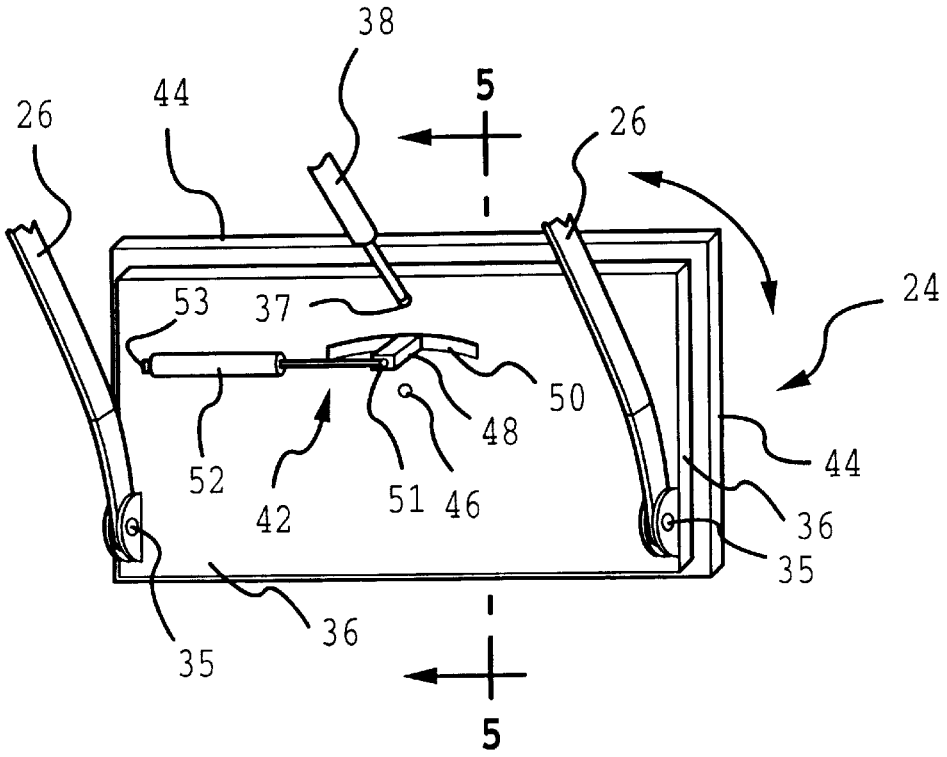
FIG. 4 is a partial perspective view looking forwardly from the vehicle shown in FIGS. 1–3 of a quick attachment mechanism connected to forward ends of boom arms of the vehicle.
Figure 5:
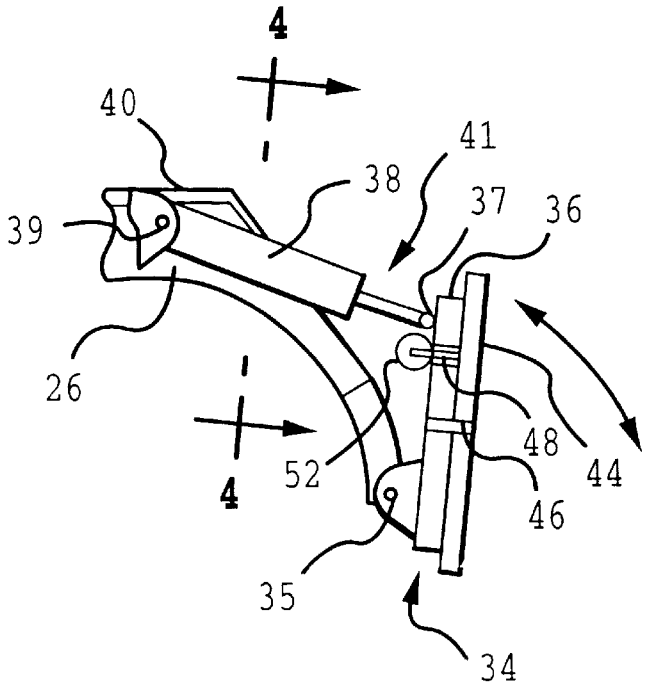
FIG. 5 is a partial side elevational view, with portions broken out for clarity, of the front end of the boom arms of the vehicle and the quick attachment mechanism shown in FIGS. 3 and 4.

In general, the quick attachment mechanism 34 comprises a connection plate 36 which is pivotally connected at points 35 to the lower forward ends of the boom arms 26, as shown in FIGS. 4 and 5. A forward end 37 of a tilt control hydraulic cylinder 38 connects to the plate 36 at a location above and between the lower points 35 where the boom arms 26 connect to the plate 36. As shown in FIG. 5, a rear end 39 of the tilt control hydraulic cylinder 38 connects to a cross member 40 (FIGS. 1 and 2) which extends between the boom arms 26 at a location slightly in front of the front end of the vehicle frame structure 30.

A conventional tilt control mechanism 41 is created by the connections of the tilt control hydraulic cylinder 38, the boom arms 26 and the connection plate 36. The degree and extent of tilting of the quick attachment mechanism 34 is established by the amount of extension and retraction position of the tilt control hydraulic cylinder 38. The tilting movement occurs in a vertical or elevational plane as shown in FIGS. 3 and 5. Of course, any implement or attachment connected to the quick attachment mechanism 34 also pivots in the same manner. For example, the tilt control hydraulic cylinder 38 tips upward an attached scoop bucket (not shown) to confine the contents within the scope bucket and drops downward the attached scoop bucket to dump or discharge the contents of the bucket. As will be understood from the following description, the tilt control mechanism 41 is used to assist in establishing the degree of surface contact of the sweeping apparatus 20 with a surface from which loose particles are swept.

In addition, the quick attachment mechanism 34 may also include a conventional swivel mechanism 42, shown in FIGS. 4 and 5. The swivel mechanism 42 is formed by a swivel plate 44 which is pivotally connected in front of the connection plate 36 at a pivot point 46. A tab 48, which is rigidly connected to the swivel plate 44, extends rearwardly through a slot 50 formed in the connection plate 36. One end 51 of a swivel control hydraulic cylinder 52 connects to the tab 48, and the other end 53 of the hydraulic cylinder 52 connects to the attachment plate 36.

By controlling the amount of extension and retraction of the swivel control hydraulic cylinder 52, the amount of swivel of the swivel plate 44 relative to the attachment plate 36 is established. The swiveling movement occurs rotationally around a forward-extending axis 54, shown in FIG. 2, which extends through the swivel point 46. The axis 54 also extends in a direction parallel to and directly forward from the vehicle 22. The axis 54 also coincides with the direction of normal forward movement of the sweeping apparatus 20. The orientation of the quick attach mechanism 34 is generally perpendicular to the axis 54. The swivel plate 44 connects to the implement or attachment connected to the quick attach mechanism 34, such as the sweeping apparatus 20, and thus the swivel position of the swivel plate 44 also establishes the swivel position of an implement or attachment connected to the quick attach mechanism 34.

In the embodiment shown in FIGS. 1–3, the sweeping apparatus 20 is constructed as an implement or attachment for a skid steer vehicle 22, and preferably one which is connectable to the swivel plate 44 of the quick attachment mechanism 34. As will be understood from the following description, the ability to control the degree of swivel movement of the sweeping apparatus 20 about the axis 54, along with the degree of pivoting movement from the tilt control mechanism 41, assures that the best cleaning action is obtained from the sweeping apparatus 20.

The sweeping apparatus 20 includes a frame structure 56 which supports the other components of the sweeping apparatus 20, as shown in FIGS. 6 and 1–3. The frame structure 56 connects to the swivel plate 44 of the quick attachment mechanism 34. The frame structure 56 is formed by a plurality of square or rectangular steel tubes which have been welded or otherwise connected together.

The sweeping apparatus 20 comprises a rotational brush assembly 57 which is formed by a plurality of elongated bar members 58 which extend between and are rotationally connected at their opposite ends to a pair of wheel or disk rotational members 60 and 62, shown in FIGS. 1, 3, 6 and 7. A strip brush member 64 is connected to and extends along the length of each bar member 58. Each strip brush member 64 includes a plurality of bristles 66 which contact the surface to be swept and move loose particles from that surface as the brush assembly 57 rotates.

Figure 6:
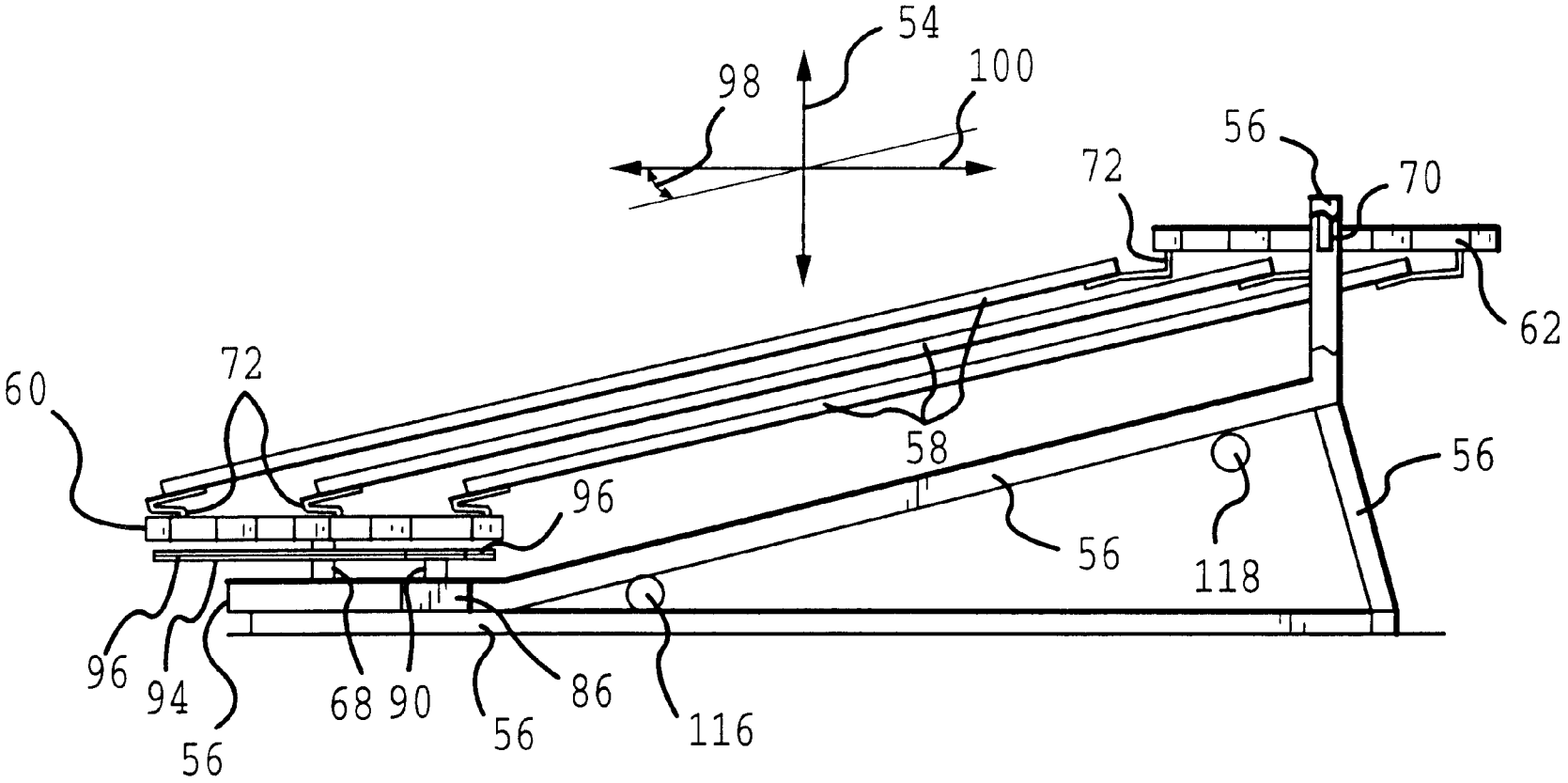
FIG. 6 is an enlarged plan view of the sweeping apparatus shown in FIGS. 1–3.
Figure 7:
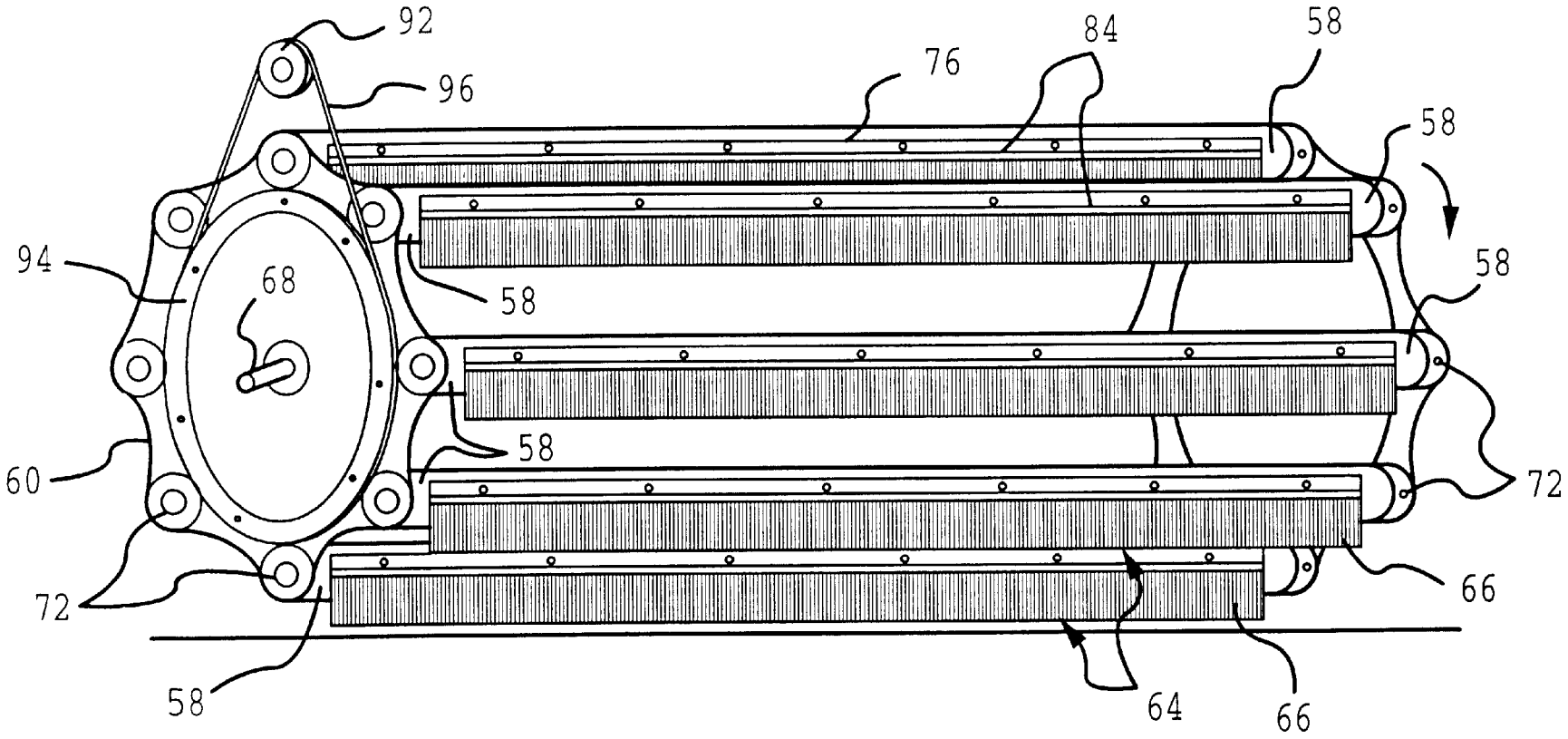
FIG. 7 is an elevational view of a brush assembly of the sweeping apparatus shown in FIG. 6, looking forward from the vehicle.

As shown in FIGS. 6 and 7, the disk member 60 is rotatably supported on an axle 68 which extends from and is carried by the frame structure 56. Similarly, the other disk member 62 rotates about an axle 70 connected to the opposite end of the frame structure 56. The disk numbers 60 and 62 are oriented so that their rotational axes about the axles 68 and 70 are parallel to one another. Consequently, the disk members 60 and 62 rotate in parallel planes. As shown in FIGS. 2 and 6, the rotational planes of the disk members 60 and 62 are approximately perpendicular to the forward axis 54 of the vehicle 22.

The ends of the bar members 58 are rotationally connected to the disk members 60 and 62 at conventional rotational joints 72. Each rotational joint 72 may be a bearing, for example. The rotational joints 72 on each disk member 60 and 62 are located at corresponding positions on the disk members 60 and 62. Consequently, the rotational joints 72 are located at the same radial distance from the axles 68 and 70, and the radial angle and peripheral spacing between the rotational joints 72 is the same on each disk member 60 and 62. The bar members 58 extend directly between and connect to corresponding opposite rotational joints 72 of the disk members 60 and 62. The rotational joints 72 allow the bar members 58 to extend in the angular direction with respect to each disk member 60 and 62 as each disk member rotates.

The frame structure 56, the disk members 60 and 62 and their connection to the frame structure 56, the bar members 58 and their connection to the disk members 60 and 62 to allow rotation of the disk members and movement of the bar members in a rotational pattern, are all conventional aspects of a well known agricultural implement known as a side discharge rake.

Figure 8:
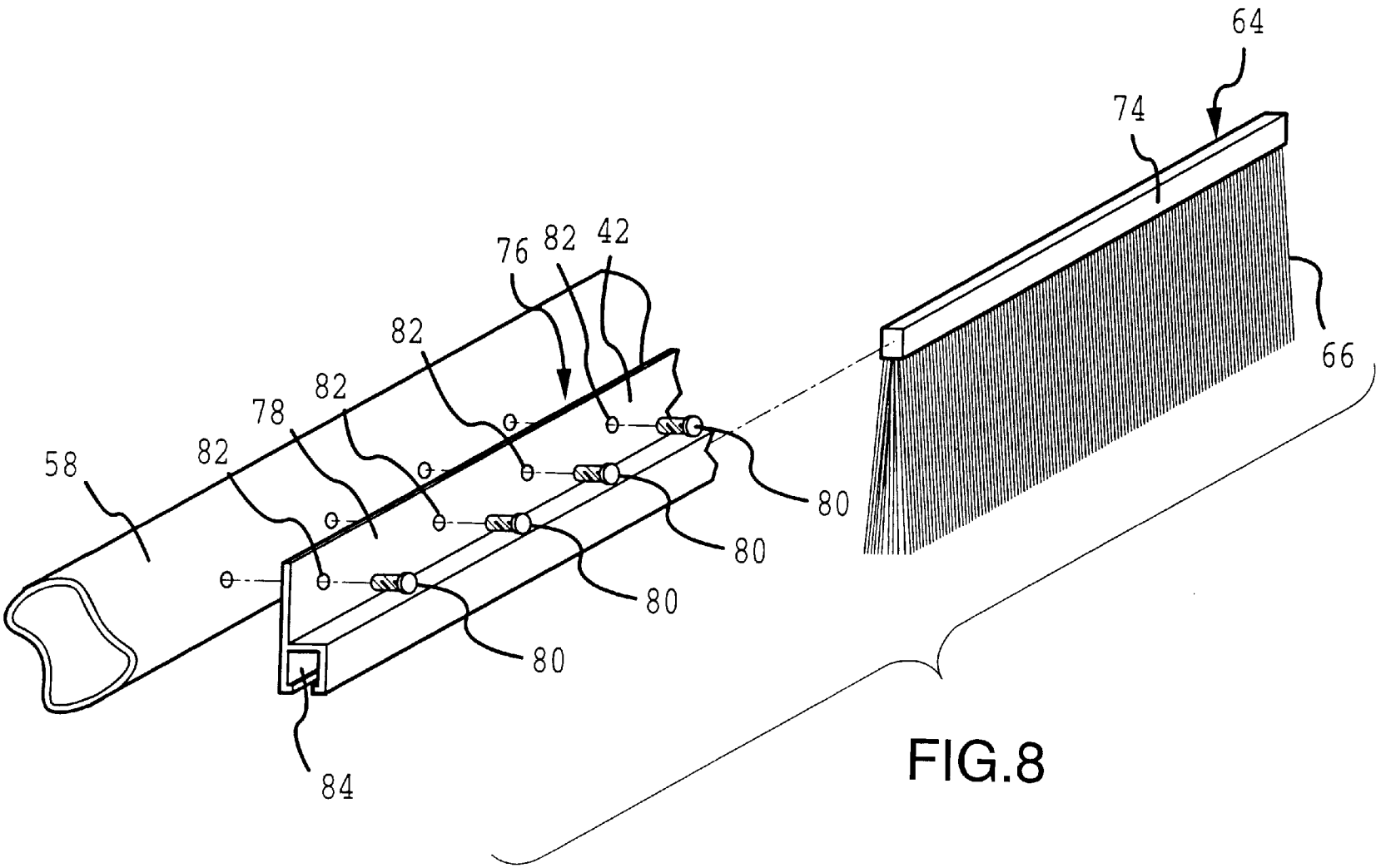
FIG. 8 is an exploded view of portions of the sweeping apparatus shown in FIGS. 6 and 7, illustrating portions of a bar member, a strip brush member and a mounting bracket which attaches the strip brush member to the bar member.

Each strip brush member 64 is conventional, and is shown in greater detail in FIG. 8. Each strip brush member 64 includes a plurality of downward extending and generally parallel oriented bristles 66. The bristles 66 are captured and retained in a retaining structure 74 of each strip brush member 64. The upper ends of each bristle 66 are held in the retaining structure 74 by an adhesive or from friction resulting from resilient force applied by crimping a metal retaining structure 74 onto the upper ends of the bristles.

A mounting bracket 76 connects the strip brush member 64 to the bar members 58, as shown in FIG. 8. The mounting bracket 76 includes a flange 78 which is attached to a bar member 58, preferably by bolts 80 which extend through holes 82 formed in the flange 78. The mounting bracket 76 also includes a channel portion 84 into which the bristle retaining structure 74 of the strip brush member 64 is inserted. Once in position, the strip brush member 64 is held in position by bolts or screws (not shown) which extend through the channel portion 84 and the bristle retaining structure 74. By use of the channel portion 84, the strip brush members 64 can be easily replaced when worn. Furthermore, different types of brush members 64 may be substituted for different jobs, such as ones with stiff bristles rather than flexible bristles. Each entire strip brush member 64 can be replaced without disconnecting the mounting brackets 76 from the bar members 58. The mounting bracket 76 is conventionally used to retain force from brush members.

The brush assembly 57 is rotated by a hydraulic motor 86 shown in FIGS. 1, 2 and 6. Pressurized hydraulic fluid is supplied from the vehicle hydraulic system (not shown) to the hydraulic motor 86 through hoses 88 (FIGS. 1 and 2). A power output shaft 90 (FIG. 6) of the hydraulic motor 86 rotates under the influence of the hydraulic pressure, causing a pulley 92 connected to the output shaft 90 to rotate. Another pulley 94 is rigidly connected to the disk member 60. A belt 96 extends around the pulleys 92 and 94. When the output shaft 90 of the hydraulic motor 86 rotates, its rotational movement is transferred through the belt 96 and pulleys 92 and 94 to rotate the driven disk member 60. Preferably, a difference in size of the pulleys 92 and 94 multiplies the amount of torque for rotating the brush assembly 57.

As the hydraulic motor 86 rotates the driven disk member 60, rotational force is transferred through the parallel connected bar members 58 to rotate the other disk member 62, which functions as an idler disk member. The bar members 58 move in parallel in a rotational pattern during which the parallel bar members 58 remain extending at an angle 98 with respect to a perpendicular reference 100 to the forward axis 54 of the vehicle 22, as shown in FIG. 6. The rotational pattern occurs about an axis which extends between the center points of rotation of the disk members 60 and 62, at the axles 68 and 70. The angle 98 is between 12 and 35 degrees, and preferably 25 degrees. If the disk members 60 and 62 are aligned with the perpendicular reference 100, which is the preferable case, the bar members 58 therefore extend at an angle of between 12 and 35 degrees with respect to the disk members 60 and 62. Even if the disk members 60 and 62 are not aligned with the perpendicular reference 100, the angle between the bar members 58 and the disk members 60 and 62 is still a relatively small angle of less than 45 degrees.

Figure 9:
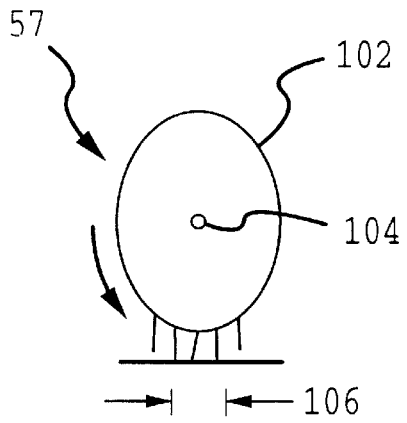
FIG. 9 is a schematic illustration of a rotational pattern of bar and brush members of the sweeping apparatus shown in FIG. 6.

As the bar members 58 move, the connected brush members 64 also move in essentially the same rotational pattern 102 shown in FIG. 9. The rotational pattern 102 shown in FIG. 9 is an oval shaped pattern when viewed along an axis of rotation 104 which extends at the angle 98 (FIG. 6) between the disk members 60 and 62. The rotational pattern 102 occurs because the disk members 60 and 62 rotate in a plane which is at an angle with respect to a rotational axis 104 of the brush assembly 57, which extends at the angle 98 (FIG. 6). In the circumstance where the disk members 60 and 62 are aligned with the perpendicular reference 100 (FIG. 6), the disk members 60 and 62 rotate at the angle 98 with respect to the rotational axis 104.

The bar members 58 and the strip brush members 64 rotate in a direction where the bristles 66 contact the surface and move forward on the surface, thereby pushing the loose material in front of the sweeping apparatus 20. As the bristles 66 move through the rotational pattern 102, the bristles 66 remain substantially vertical to the sweeping surface. With the oval shaped pattern 102 of rotation shown in FIG. 9, very little change in height occurs over a forward distance 106 through which the brush members 64 move while in contact with the surface. This short forward movement distance 106 is a consequence of the oval-shaped rotational pattern 102. The oval shaped pattern and the relatively short forward movement distance 106 does not bend or deflect the bristles 66 backwards. Instead, the entire brush member 64 may be tilted slightly backwards as it moves forward along the movement path 106 to accommodate the slight variation in height, rather than bending the bristles. As the strip brush member 64 moves forwardly to the fullest forward extent of its forward travel path 106, the bristles 66 become more vertical and lift or withdraw quickly and almost straight upwardly away from the swept surface. The relatively rapid upward movement of the bristles 66 is again a consequence of the oval shaped rotational pattern 102. Thus, when the bristles 66 withdraw from the swept surface, they are almost vertical in orientation and they are moving vertically.

Figure 10:
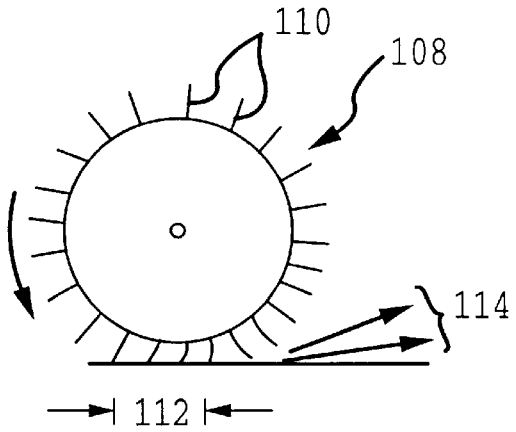
PRIOR ART FIG.10
FIG. 10 is a schematic illustration of a rotational effect of a prior art rotational bristle brush.

The lack of rearward deflection or bending movement of the bristles 66 and the relatively rapid vertical withdrawal of the bristles 66 from the swept surface prevents a substantial amount of the loose material and particulates from being projected or flipped upward, which is the common result of using a prior art rotating bristle brush 108 of the type shown in FIG. 10. The rotating bristle brush 108 includes a plurality of bristles 110 which extend radially outward from a rotating drum. Because only line or minimal contact with the sweeping surface would be obtained if the bristles 110 were not compressed into contact with the surface, and because that minimal contact would not be sufficient for adequate sweeping, it is common practice to move the rotating brush 108 toward the surface until the bristles 110 are bent, as shown in FIG. 10. The bent bristles cause contact with the swept surface over the larger distance 112 to achieve a better cleaning action. However, as the bristles 110 rotate out of contact with the surface, the deflection of the bristles causes the loose particulates to flip upwardly in forward trajectories 114 as the bristles 110 spring back into an undeflected shape. The loose particles traveling in the trajectories 114 become airborne and cause substantial dust and airborne pollution.

In contrast to the conventional rotating bristle brush 108 shown in FIG. 10, the sweeping action of the sweeping apparatus 20 of the present invention causes a substantial reduction in the amount of dust and airborne particles introduced into the environment. The vertical orientation and vertical withdrawal of the bristles 66 from the swept surface greatly reduces or prevents the loose particles from being projected into the air. For example, it is not uncommon that the amount of dust from the present invention is reduced by an estimated amount of one fourth to one third of that created by a conventional rotating bristle brush.

Even though the forward movement path 106 (FIG. 9) is relatively short, a plurality of strip brush members 64 are in contact with the swept surface over the relatively short distance 106. This results as a consequence of the oval rotational pattern. At least two and usually three separate strip brush members 64 will typically be in contact with the swept surface when the rotating brush assembly 57 has approximately eight or more bar members 58 and brush members 64 connected to it. Thus, the multiple brush contact with the surface causes a very effective sweeping action, even though the contact distance 106 may be relatively short.

In addition to preventing or substantially reducing the amount of airborne particulates, the rotating brush assembly 57 is also very effective in transferring the loose particles laterally to the side of the sweeping apparatus 20. The orientation of the rotating bar members 58 and the connected brush members 64 at the angle 98 (FIG. 6), effectively pushes the loose material in a longitudinal direction along the length of the strip brush members 64. The rotary motion from the disk members 60 and 62 is converted into a longitudinal motion because of the angle of the disk members 60 and 62 with respect to the parallel bar members 58. The amount of linear movement parallel to the brush members 64 is related to the geometric cosine of the angle 98, shown in FIG. 6, while the amount of forward movement of the brush members parallel to the axis 54 is equal to the geometric sine of the angle 98. Because of the relatively small range of angles 98, a substantial majority of the pushing movement from the brush members 64 is therefore parallel to the brush members. The substantial linear component of sweeping movement at the angle 98 effectively transfers the loose particles laterally to the side and toward the rear of the sweeping apparatus 20. The material being swept is discharged in an accumulation characterized as a windrow-like row or accumulation of material. This row of material can then be picked up and transferred to a dump or removal site, if required.

The lateral sweeping movement of the present invention is substantially greater than the lateral movement of a conventional rotating bristle brush 108 (FIG. 10). A rotating bristle brush depends entirely on the angle of the brush relative to the movement path of the vehicle for a lateral transfer effect. Because the angle of the entire rotating bristle brush is only slightly at an angle, for example no greater than 30 degrees, the substantial majority of the pushing force on the loose particles is forwardly rather than laterally as is the case with the present invention. Consequently, the majority of the loose particles are continually pushed forward rather than to the side as with the present invention. The lateral pushing effect of the present invention is estimated to be at least two times greater than that available from a rotating bristle brush. Consequently, more energy is required to sweep the surface with a rotating bristle brush because the loose materials are moved more forwardly in front of the rotating bristle brush, requiring more sweeping action to be applied to those particles before they are moved to the side of the swept path. In contrast, because of its effective lateral movement of the loose particles, the present invention applies less energy to move the particles out of the swept path.

As a result, the sweeping action of the present invention is more efficient and/or the sweeping speed of the vehicle may be increased with the present invention, compared to a rotating bristle brush. The more efficient sweeping allows a surface to be cleaned more quickly, with less energy applied to cleaning a surface area compared to a rotating bristle brush. Reduced air turbulence also results because of the linear, oval-shaped rotational pattern of the brush members of the present invention, compared to the entire number of the rotating bristles moving independently in a circular rotational pattern in the air. In addition, slower rotational speeds of the brush members 64 in the rotational path 102 (FIG. 9) are possible, which also reduces the air turbulence and projection of the particles as dust into the air.

To obtain the best sweeping contact action between the rotating brush assembly 57 and the surface to be swept, gauge wheels 116 and 118 are used, as shown in FIGS. 2 and 3. The gauge wheels 116 and 118 are castor wheels which are connected to the frame structure 56. The gauge wheels 116 and 118 support the sweeping apparatus relative to the surface and help to establish the best relative height of the bristles 66 with respect to the surface. In addition to the gauge wheels 116 and 118, the tilt control mechanism 41 and the swivel control mechanism 42 are useful. Because the forward end of the sweeper apparatus adjoining the idler disk member 62 extends a greater forward distance from the pivot points 35 (FIGS. 4 and 5), the forward ends of the brush members 64 will be an a different elevation than the rear ends of the brush members adjoining the driven disk member 60, when the tilt control mechanism 41 pivots. Thus, to bring the brush members 64 into uniform contact with the surface along their entire length, a slight swivel movement from the swivel control mechanism 42 is required. For example, when the tilt control mechanism 41 lifts up the front end adjoining the idler disk member 62, it will be necessary to rotate the rotating brush assembly 57 with the swivel mechanism to raise the driven disk member 60 and lower the idler disk member 62 until the brush members are in equal contact with the surface. Once the tilt and swivel adjustments have been made, the boom arms 26 are placed in a "float" position where the hydraulic cylinders 32 do not apply force to the boom arms 26. In the float position, the weight of the sweeping apparatus 20 is supported primarily on the gauge wheels 116 and 118, while the amount of bristle contact with the surface is established by the gauge wheels and the tilt and swivel control mechanisms.

Many variations of aspects of the present invention are possible. The length of the bar members 58 may vary, depending upon the desired operating width of the sweeping apparatus 20. For example, a convenient length for the bar members is in the range of about 3 to 12 feet. The diameter of the disk members 60 and 62 is preferably in the range of about 12 to 36 inches. In general, the larger the diameter of each disk member, greater numbers of bar members 58 and strip brush members 64 can be attached. There are at least three bar members on the rotating disk members 60 and 62, but preferably there are about 8 to 12 of such bar members and brush members. The increased number of brush members increases the number of brush members which are in contact the swept surface at any time, and also reduces the rotational speed of the brush assembly required for effective cleaning.

Figure 11:
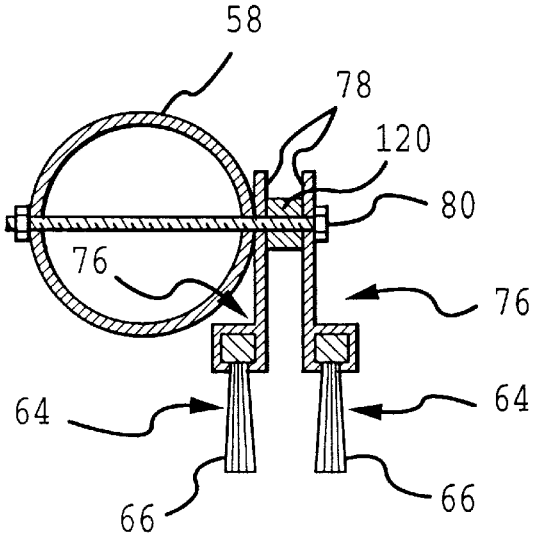
FIG. 11 is a side sectional view taken in a plane substantially perpendicular to a bar member, illustrating the connection of two brush members to a bar member, as another embodiment of the connection arrangement shown in FIG. 8.

More than one brush member 64 may be connected to each bar member 58, as is shown in FIG. 11. As shown, two mounting brackets 76 and two connected strip brush members 84 are connected by single bolts 80 extending through the flanges 78. A spacer 120 is positioned between the flanges 78 to separate the bristles 66 of the two brush members 64. By connecting two brush members 64 to each bar member 58, an increased sweeping action is obtained.

The speed at which the brush assembly 57 is rotated may vary. Generally, a satisfactory rotational speed will occur in the range of about 40 to 100 rpm, compared to a rotational rate of about 150 rpm and higher for a conventional rotating bristle brush. Although a hydraulic motor 86 is shown, other types of power sources could be employed, such as a PTO shaft, gasoline engine, electric motor, etc. Serviceability and simplicity lends itself to the adaptation of different types of bristles for any number of different sweeping applications. The brush members 64 can be easily detached and replaced with a different size or type of brush as desired for different sweeping jobs.

The present invention may be embodied in forms other than as an attachment for a skid steer vehicle. The brush assembly 57 can operate as an attachment to existing power sweeper unit or can be retrofitted to other dedicated power sweepers. The brush assembly 57 can be constructed as a separate wheeled implement to be pulled behind a tractor, in a form similar to an agricultural side discharge rake, for example. The brush assembly 57 can be oriented so that the brush members are oriented perpendicular to the path of sweeping travel.

Presently preferred embodiments of the invention and its improvements have been described with a degree of particularity. This description has been made by way of preferred example. It should be understood that the scope of the present invention is defined by the following claims, and should not be unnecessarily limited by the detailed description of the preferred embodiment set forth above.

The invention claimed is:

1. Sweeping apparatus for connection to a vehicle to move said sweeping apparatus over a surface in a forward direction of movement parallel to a forward direction of movement of the vehicle over the surface, said sweeping apparatus transferring loose material from the surface primarily laterally outward with respect to the forward direction of movement of said sweeping apparatus and the vehicle, said sweeping apparatus comprising:

a frame structure for connection to the vehicle;

first and second rotational members rotatably connected to the frame structure to rotate in parallel planes with respect to one another;

a plurality of elongated bar members connected to and extending between corresponding locations on the first and second rotational members, the bar members extending generally parallel to one another and to the surface, the bar members also extending at a predetermined acute angle of less than 45 degrees with respect to the rotational plane of each rotational member, and the bar members further extending at a predetermined acute angle of from 12 to 35 degrees with respect to a perpendicular reference relative to the forward direction of motion;

each bar member connecting to a rotational member at a rotational joint which permits rotation of the rotational members and simultaneous rotational and longitudinal movement of the parallel bar members, each bar member maintaining the predetermined acute angle of less than 45 degrees with respect to the rotational planes of the rotational members as the rotational members rotate;

means for transferring rotational force to at least one of the rotational members to rotate the rotational members and move the parallel bar members; and a brush member connected to and extending along the length of each bar member between the rotational members, the brush member having bristles which move into contact with the surface and push the loose particles as each bar member moves; and wherein the predetermined angular orientation of the rotational members relative to the bar members and the predetermined angular orientation of the bar members relative to the perpendicular reference causing:

the bar members to move rotationally in an oval rotational pattern about a rotational axis extending between center rotational points of the rotational members;

the oval rotational pattern to contact the bristles with and to withdraw the bristles from the surface in a substantially vertical orientation;

the bar members to move longitudinally in a direction parallel to the rotational axis;

the longitudinal movement of the bar members to contact the bristles with the loose material to push the loose material in a lateral outward and rearward direction with respect to the forward direction of movement; and the component of the longitudinal pushing movement from the bristles in a direction parallel to the rotational axis to be greater than the component of pushing movement from rotation of the bristles in a direction perpendicular to the rotational axis.

2. Sweeping apparatus as defined in claim 1 wherein the rotational axis and the predetermined acute angle of the bar members extend at an angle of approximately 25 degrees with respect to the perpendicular reference.

3. Sweeping apparatus as defined in claim 1 wherein the rotational members rotate in planes which are substantially parallel to a perpendicular reference to the forward direction of movement.

4. Sweeping apparatus as defined in claim 2 wherein the bar members extend at predetermined acute angles from the rotational members in the range of 12 to 35 degrees.

5. Sweeping apparatus as defined in claim 1 wherein the vehicle is a skid steer vehicle, and the frame structure includes a connection structure to connect said sweeping apparatus to the front end of a skid steer vehicle.

6. Sweeping apparatus as defined in claim 5 wherein the skid steer vehicle has boom arms and the connection structure connects to the boom arms.

7. Sweeping apparatus as defined in claim 1 wherein the vehicle is a skid steer vehicle having broom arms and a quick attachment mechanism connected to the boom arms, and the frame structure includes a connection structure to connect with the quick attachment mechanism.

8. Sweeping apparatus as defined in claim 1 wherein the vehicle includes wheels, and said sweeping apparatus further comprises:

gauge wheels connected to the frame structure for supporting said sweeping apparatus with respect to the surface separately from the vehicle wheels, the gauge wheels establishing the amount of contact of the bristles with the surface.

9. Sweeping apparatus as defined in claim 8 wherein the vehicle is a skid steer vehicle having boom arms, a tilt control mechanism and a swivel control mechanism, the tilt and swivel control mechanisms connected to front ends of the boom arms, and wherein the frame structure includes a connection structure to connect to the tilt control and swivel control mechanisms to tilt and swivel said sweeper apparatus and position the rotational axis to contact the bristles with the surface over substantially the entire length of the brush members.

10. Sweeping apparatus as defined in claim 1 further comprising:

a source of rotational force connected to the frame structure; and wherein:

the rotational force transferring means comprises a power transfer connection between the source of rotational force and one of the rotational members; and the source of rotational force operates independently of forward movement of the vehicle and said sweeper apparatus.

11. Sweeping apparatus as defined in claim 10 wherein:

the frame structure includes a connection structure to connect to a front end of a skid steer vehicle of the type having a hydraulic system; and the source of rotational force comprises a hydraulic motor which derives rotational force from the hydraulic system.

12. Sweeping apparatus as defined in claim 11 wherein:

the power transfer connection of the rotational force transferring means comprises a pulley connected to the hydraulic motor, a pulley connected to one rotational member, and a belt extending around the pulleys.

13. Sweeping apparatus as defined in claim 1 wherein the brush member extends substantially along the entire length of the bar member.

14. Sweeping apparatus as defined in claim 1 wherein a plurality of brush members are connected to each bar member.

15. Sweeping apparatus for connection to a skid steer vehicle having boom arms, a tilt control mechanism and a swivel control mechanism, the tilt and swivel control mechanisms connected to front ends of the boom arms, the skid steer vehicle moving said sweeping apparatus over a surface in a forward direction of movement parallel to a forward direction of movement of the vehicle over the surface, said sweeping apparatus transferring loose material from a surface primarily laterally outward with respect to a forward direction of movement of said sweeping apparatus and the skid steer vehicle, said sweeping apparatus comprising:

a frame structure having a connection structure to connect to the tilt control and swivel control mechanisms; and a rotational brush assembly having a plurality of elongated strip brush members which are oriented at a predetermined acute angle with respect to a perpendicular reference to the forward direction of movement and which move simultaneously in an oval rotational pattern about a rotational axis and in longitudinal movement parallel to the rotational axis, the movement of the strip brush members inducing substantially more pushing movement on the loose particles in a direction laterally outward parallel to the rotational axis than in a direction perpendicular to the rotational axis; and wherein:

the tilt control and swivel control mechanisms respectively tilt and swivel said frame structure to position the elongated strip brush members in contact with the surface over substantially the entire length of the strip brush members.

16. Sweeping apparatus as defined in claim 15 wherein:

the oval rotational pattern contacts the strip brush members with and withdraws the strip brush members from the surface and the loose material in a substantially vertical orientation.

17. Sweeping apparatus as defined in claim 15 wherein the predetermined acute angle causes the longitudinal movement of the strip brush members to contact and push the loose material in a lateral outward and rearward direction with respect to the forward direction of movement.

18. Sweeping apparatus for connection to a vehicle to move said sweeping apparatus over a surface in a forward direction of movement parallel to a forward direction of movement of the vehicle over the surface, said sweeping apparatus transferring loose material from the surface primarily laterally outward with respect to the forward direction of movement of said sweeping apparatus and the vehicle, said sweeping apparatus comprising:

a frame structure for connection to the vehicle;

first and second rotational members rotatably connected to the frame structure to rotate in parallel planes with respect to one another, the rotational planes of the rotational members extending substantially parallel to a perpendicular reference to the forward direction of movement;

a plurality of elongated bar members connected to and extending between corresponding locations on the first and second rotational members, the bar members extending generally parallel to one another and to the surface, the bar members also maintaining a predetermined acute angle with respect to the rotational plane of each rotational member and with respect to the perpendicular reference relative to the forward direction of motion;

each bar member connecting to a rotational member at a rotational joint which permits rotation of the rotational members and simultaneous rotational and longitudinal movement of the parallel bar members, each bar member maintaining the predetermined acute angle with respect to the rotational plane of the rotational members as the rotational members rotate;

means for transferring rotational force to at least one of the rotational members to rotate the rotational members independently of the forward movement of the vehicle; and a brush member connected to and extending along the length of each bar member between the rotational members, the brush member having bristles which move into contact with the surface and push the loose particles as each bar member moves; and wherein:

the predetermined angular orientation of the rotational members and extension of the bar members relative to the rotational members causing the bar members to move longitudinally in a direction parallel to the rotational axis, the longitudinal movement contacting the bristles with the loose material to push the loose material in a lateral outward and rearward direction with respect to the forward direction of movement.

19. Sweeping apparatus as defined in claim 18 wherein the component of the longitudinal pushing movement from the bristles in a direction parallel to the rotational axis is greater than the component of pushing movement from rotation of the bristles in a direction perpendicular to the rotational axis.

20. Sweeping apparatus as defined in claim 18 wherein:

the bar members move rotationally in an oval rotational pattern about a rotational axis extending between center rotational points of the rotational members; and the oval rotational pattern contacts the bristles with and withdraws the bristles from the surface in a substantially vertical orientation.

* * * * *